US005762597A

United States Patent [19]

Valterio

[11] Patent Number: 5,762,597

[45] Date of Patent: Jun. 9, 1998

[54] MODULAR FOLDING DEVICE IN A FOLDER-GLUER MACHINE FOR PROCESSING FLAT ELEMENTS

[75] Inventor: Roberto Valterio, Chesieres, Switzerland

[73] Assignee: Bobst SA, Lausanne, Switzerland

[21] Appl. No.: 717,609

[22] Filed: Sep. 23, 1996

[30] Foreign Application Priority Data

Sep. 21, 1995 [CH] Switzerland ..... 02672/95

[51] Int. Cl.[6] ..... B65H 45/22

[52] U.S. Cl. ..... 493/423; 493/441

[58] Field of Search ..... 493/423, 441, 493/476, 478, 479

[56] References Cited

U.S. PATENT DOCUMENTS 4,795,416 1/1989 Cogswell ..... 493/441
5,114,392 5/1992 McAdam, III ..... 493/423
5,151,075 9/1992 Beaulieu et al. .

FOREIGN PATENT DOCUMENTS 1 044 793 11/1953 France .
2 358 976 2/1978 France .
850 988 9/1952 Germany .

*Primary Examiner*—Jack W. Lavinder
*Attorney, Agent, or Firm*—Hill, Steadman & Simpson

[57] ABSTRACT

A folding device for blanks has the shape of a removable module with an integrated securing device for securing the module in the frame of a machine. The module has two series of pulleys, which have a common drive drum and provide a path for a first belt having an upper twisted folding path and a second belt having a lower planar part. The drum is provided with a connecting element to connect the drum directly to a shaft normally provided to drive a gluing wheel which the module replaces.

9 Claims, 2 Drawing Sheets

MODULAR FOLDING DEVICE IN A FOLDER-GLUER MACHINE FOR PROCESSING FLAT ELEMENTS

BACKGROUND OF THE INVENTION

The present invention is directed to a modular removable folding device for a folder-gluer machine processing flat elements, particularly blanks of cardboard boxes.

A folder-gluer is a machine in which blanks of a box are taken one-by-one from the bottom of a stack. The blanks are then conveyed through different sections for folding and/or gluing by means of belt conveyors in order to form a "flat folded" and glued blank which is collected in a terminal stacking station.

For a type of box called a "crash-lock bottom", the chronology of the operation usually is: a pre-breaking of the side tabs, folding of the simple front right and composite left tabs with reopening of the side tabs, folding of the composite front center-right tab, gluing from the top of the composite front tabs, gluing from the bottom of the side tab and folding of the simple front-left tab, folding along the second and fourth lengthwise creases with the right edge of the blank coming to reclose in the middle over the glued side tab, pressing and stripping at the output of which each folded blank is stacked in a last delivery station.

For another type of box called "six-corner", the usual chronology of the operation is: folding of the simple front tabs, then the composite front tabs, raising and folding of the composite rear tabs, then the simple rear tabs, gluing from the top of the composite front and rear tabs in four corners on one side and two corners on the other, folding and folding back according to the first lengthwise crease of the side tab over the adjacent pair of gluing points of the front and rear tabs doubly glued, folding along the second and fourth crease with the other side tab coming to apply over the adjacent pair of gluing points, the two gluing points in the center folding back over the adjacent edges of the other composite tabs.

In order to convey the box blanks without sliding, sidewise as lengthwise, through the machine, lower and upper belt conveyors are used in combination, as well as, in certain cases, the combination of one or several lower belt conveyors with upper pressure roller tracks.

The folding-up of the front tabs effects, owing to a relatively simple device comprising one or several hooks hanging in an elastic manner on a crossbar, the lower end of these hooks being in the axis of the tab passage of the blank. The device of automatic raising of the rear tabs is a little bit more complex, because it comprises one or several subjacent hooks set in an upstream rotation only at the moment of the passage of the rear tab with a displacement speed which is higher than the one of the blank.

A folding according to a lengthwise line begins with a twisted belt made of a buffed metal, and is pursued by a twisted track formed of one or several parallel bars made of synthetic materials having a low coefficient of friction with the cardboard. When the part to be folded is heavy, the track is composed of a pair of associated driving belts, an upper twisted belt and a lower planar belt. The belts are usually led by separated pulleys in order to better control their trajectory, these pulleys being usually mounted on the same drive shaft.

The conveyors, hooks, tracks and twisted belts are permanently mounted in the machine on different crossbars, which enables an adjustment of their respective sidewise positions according to the format of the blank during a change from one type of blank to another type of blank. Notably, when changing from a production of boxes, such as "crash-lock bottom", to a production of boxes of "six-corner", the last subjacent gluing device of the side tab has to be substituted by a metallic twisted track for turning the new side tab against the adjacent pair of gluing points. For this, the gluing wheel is removed from the drive shaft and the lower glue basin is taken out.

Moreover, on the production of boxes of the "six-corner" type, the folding back of the side tab just before the final folding induces very frequently a slight displacement of the position of the blank with regard to the conveyor. This failing due to the friction between the cardboard and the metallic twisted track perceptibly warps the last folding.

SUMMARY OF THE INVENTION

The object of the present invention is a folding device of a side tab of a blank without a displacement of the position of the blank by being based on a pair of drive belts, wherein a drive belt comprising an upper twisted part for folding and a drive belt comprising, in correspondence, a lower planar part, which, although more complex than the simple metallic twisted ramp, can be installed very easily instead of the gluing device comprising a glue wheel placed in rotation by a shaft. Nonetheless, the functioning of this device has to remain reliable, and its conception has to be as simple as possible in order to reduce accordingly the cost of manufacturing.

These objects are achieved in a folding device that is a removable module integrating means for securing on the frame of the machine, two series of pulleys defining with one or two drive drums, respectively, the passage of the belt with a twisted parts and the belt with the planar parts in correspondence, and means for connecting the drums to the drive shaft in place of the gluing wheel.

The handling of the complete module, which is made of one block and which may require means for lifting, is proving practically as simple as the one of the metallic track. Notably, the correct positioning of this module provides an accurate positioning of the belts without additional adjustments. Moreover, the inspection and maintenance of each of the modules is greatly simplified once the module is removed from the machine.

According to a preferred realized mode, the module comprises a vertical planar main support, such as a metallic plate, the external surface has securing means in the form of a bracket for securing to the frame of the machine, whereas the internal surface faces two series of pulleys for the two belts and the drive drums. If desired, the internal surface comprises, besides, a metallic track for guiding and support of the part of the twisted folding belt. This simplified structure makes it easier for realizing the module and for positioning the module in the machine.

According to the preferred mode for realization, the internal surface of the main support of the module carries only a single wide drive drum for receiving the two belts side-by-side. This main support has a passage for the drive shaft of the gluing wheel for direct connection with a hub of the drum. Notably, the hub presents a conical surface coming in contact with the complementary conical surface of the end of the shaft. This simplified arrangement limits the loss of mechanical power between the drive shaft and the belts. Moreover, it ensures that the speeds for the two belts are practically identical.

Advantageously, the main support presents an upstream extension for the path of the twisted part of the belt. Thus, the dimensions of the main support are optimized.

According to a favorable mode of realization, the module comprises a vertical planar secondary support extending parallel to the main support and arranged opposite the path of the belt with the planar part. This secondary support carries the guiding pulleys for the belt with the planar path or part. This secondary support forms the internal front of the module protecting the drum and partially the pulleys and belts. This secondary support is particularly useful in order to carry an elastic device for tightening the pulleys, which elastic device comprises a movable piece along a rectilinear opening employed within the support, and this opening may be at a position wherein the frame of the machine would prevent access to this device within the main support.

Advantageously, the main support is provided along its upper edge with means for gripping or lifting, which are in the form of a pair of handles.

The securing means on the frame belonging to the external surface of the main support of the module may have the form of a horizontal plate, which is applied on an upper surface of the piece of the frame of the main machine. The plate presents one or several slots or openings, which can receive means for fixing the plate against the frame member, and the length of the slots or openings allows an adjustment of the position of the module before clamping with the fastening means, such as screws or bolts. Preferably, the piece of the frame is, itself, mounted on a crossbar in order to be adjusted in its transverse position in the frame of the machine.

Other advantages and features of the invention will be readily apparent from the following description of the preferred embodiment, the drawings and claims.

DESCRIPTION OF THE PREFERRED EMBODIMENTS

Figure 1:
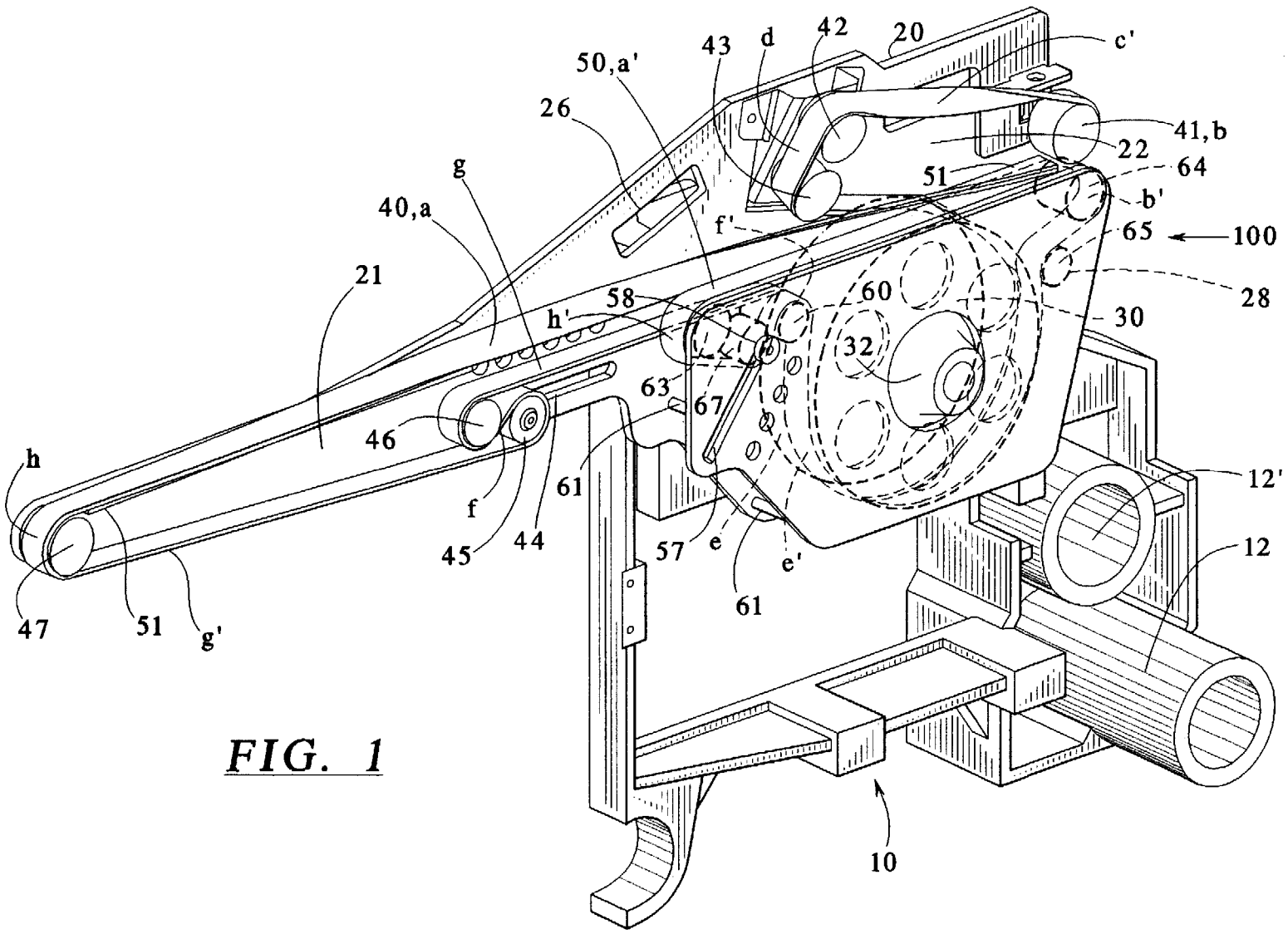
FIG. 1 is a perspective view of a folding module according to the present invention as seen from an interior position.
Figure 2:
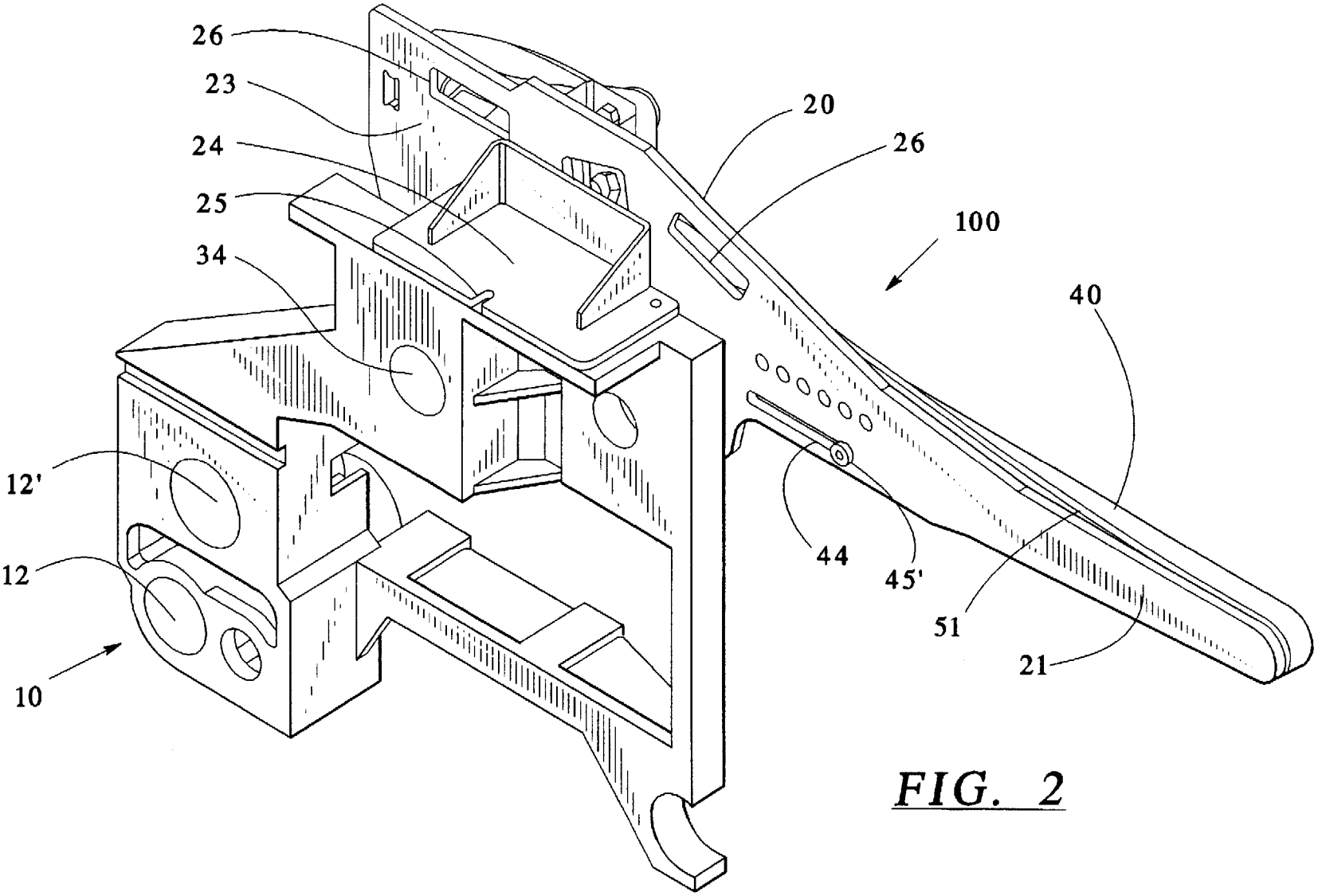
FIG. 2 is a perspective view of the module of the present invention as seen from an exterior surface having a portion of the frame.

The principles of the present invention are particularly useful in a folding module, generally indicated at 100 in FIGS. 1 and 2. The folding module 100 is installed instead of a gluing device on a piece 10 of the main frame of a folding and gluing machine. The piece or member 10, at a downstream end, has two hollow pipe-like sockets 12 and 12', which receive two cylindrical crossbars of the machine. One of the cylindrical sockets has a smooth cylindrical surface, while the other has a threaded surface to be received on a threaded member to allow positioning of the piece in the transverse position in the machine. The upstream end of the piece 10 also has a semi-circular slot or socket, which will fit on another cylindrical crossbar of the machine.

As best illustrated in FIG. 2, the folding module 100 is built around a vertical planar main support plate 20, which has an external surface 23 which is provided with a horizontally-extending bracket or plate 24, which will rest on an upper surface of the frame member or piece 10. The plate 24 has one or several slots or oblong apertures 25 for receiving fixing screws which form means for fixing or securing the module on the frame of the machine. These oblong apertures enable an adjustment of the position of the module 100 with regard to the frame member 10 before final clamping or securing.

Along an upper edge of the plate 20, two rectangular apertures 26 are provided and form simple gripping handles for enabling an operator to remove and replace the folding module. If required, a chain may be passed between these two apertures to enable lifting the module by a lifting means.

As illustrated in FIG. 1, an internal surface 22 of the main support plate 20 carries, in the middle of its lower part, a drive drum 30, which is mounted in a bearing and is free to rotate on the bearing. A conical central hub of this drum may be attached directly to a conical end 32 of a transmission shaft 34 (FIG. 2), normally provided to drive the gluing wheel. The transmission shaft 34 extends from the external surface and crosses the piece or member 10 of the frame and then passes through a corresponding opening in the main plate 20 in order to reach the hub of the drum 30.

As illustrated in the two Figures, the main plate 20 has an upstream extension 21 enabling the installation of one end of a long twisted metal track 51 adjacent the internal surface 22 at the extension 21. The track 51, at the downstream end, is spaced from the internal surface 22 approximately one width of a belt 40. The track enables folding and turning back the side tab of the blank.

More particularly, according to the invention, the metal track 51 is covered along a part a by an upper belt 40, which runs from an upstream pulley 47 along a twisted path a to a downstream pulley 41 located at the downstream end of the track 51. The belt 40 effects a half-turn along a path b, and then is provided with a reversed twist as it moves along a path c to an upper pulley 42 before moving in a path d to a third pulley 43, which orients the belt 40 adjacent the inner surface 22 and passes the belt onto the drive drum 30. On the drive drum 30, the belt extends to a pulley 60 to form a winding angle or path e. At the output of the drum, the belt, after passing over the pulley 60, again travels in a horizontal path g to a pulley 46, where it passes around and extends in a path f around a tightening pulley 45 in order to again start a horizontal path g' to the pulley 47 on the upstream extension. At the pulley 47, the path again makes a reverse bend in a path h to again start the twisted trajectory along the twisted track 51. As seen in FIG. 1, an axle for the pulley 45 passes through a lengthwise aperture 44, on the back of which has an end 45' (see FIG. 2) which can be urged downstream by a non-illustrated elastic means, such as a spring.

As illustrated in FIG. 1, a secondary vertical plate 28 is fixed to extend parallel to the main plate 20 by a plurality of distance pieces, such as spacers 61. A surface of the secondary plate 21, which faces the main plate 20, carries a plurality of pulleys for guiding a lower or second belt 50 having a planar path a1 extending from a pulley 63 to a pulley 64, which planar path a1 faces the downstream third of the twisted path a of the upper belt 40. The pulley 64 is positioned adjacent and below the pulley 41. At the pulley 64, the belt 50 has a return bend, shown by a path b', which passes around a guide pulley 65, which holds it against a surface of the drum 30 as it moves in the path e' to the pulley 60, which is common to both belts 40 and 50. As the belt passes around the pulley 60, it has a run f' around a take-up pulley 67, which has an axle 58 sliding in an elongated slot 57 and biased by a non-illustrated tightening elastic means, such as a spring. The belt 50 is then returned to a return bend of a path h' around the pulley 63 to again begin the path a'.

The module 100 is relatively easy insofar as it is sufficient to place it in position by lowering it slowly by means of the handles 26 in order to put it on the upper surface of the frame member 10 of the frame. After an adjustment of the position, the clamping screws extending through the slots 28 can be tightened to lock the module in place. Then the coupling of the conical end 32 of the transmission shaft 34 onto the hub of the drum 30 can be obtained. After having started the machine, the drum simultaneously drives the two belts 40 and 50, which run at practically the same speed. Thus, a side tab of a blank coming to the level of the metallic track 51 comes into contact with the upper belt, which carries it while effecting a fold. When the tab is turned more than 90°, a lower part of the blank is then engaged by the lower drive belt 50, as well, and the end of the folding occurs in a reliable manner between the two belts, which advance at the same speed, and, thus, avoid any displacement of the position of the blank on the belts.

Although various minor modifications may be suggested by those versed in the art, it should be understood that I wish to embody within the scope of the patent granted hereon all such modifications as reasonably and properly come within the scope of my contribution to the art.

I claim:

1. A module containing a folding device, said module replacing a gluing device comprising a gluing wheel rotated by a shaft of machine, said module comprising a vertical main support plate with an external surface and an internal surface, securing means for securing the module on a frame of the machine being provided on the external surface, a secondary vertical support plates being mounted to face the internal surface of main support plate to extend parallel thereto with a spacing therebetween, said module having a first series of pulleys on the internal surface for guiding a first belt having an upper twisted folding path and a second series of pulleys supported on the secondary vertical support plate for guiding a second belt having a corresponding lower planar path, said module having drive means including a drive drum common to both belts having a connecting element for engaging the drum on a drive shaft used for the gluing wheel.

2. A module according to claim 1, wherein the internal surface of the main support of the module carries only a single drive drum for receiving the two belt side-by-side, said main support having a passage for the drive shaft of the gluing wheel for direct connection with a hub of the drum.

3. A module according to claim 1, wherein the main support has an upstream elongation to provide an extension for the twisted path of the first belt.

4. A module according to claim 1, wherein the main support plate along an upper edge is provided with gripping means.

5. A module according to claim 1, wherein the securing means of the frame is mounted on an external surface of the main support of the module and has the shape of a horizontal plate coming to rest on an upper surface of the member of the frame, said plate having at least one slot extending transversely for receiving fixing means for securing the plate against the frame member, the length of the slot allowing an adjustment of the position of the module before a clamping by the fixing means.

6. A module containing a folding device, said module replacing a gluing device comprising a gluing wheel rotated by a shaft of a machine, said module comprising a vertical main support plate with an external surface and an internal surface, said module on the internal surface having a first series of pulleys for guiding a first belt having an upper twisted folding path and a second series of pulleys for guiding a second belt having a corresponding lower planar path, drive means including a drive drum common to both belts having a connecting element for engaging the drum on a drive shaft used for the gluing wheel, said module having securing means for securing the module on a frame member of a frame of the machine, said securing means being mounted on the external surface of the main support plate and having the shape of a horizontal plate coming to rest on an upper surface of the frame member, said plate having at least one slot extending transversely for receiving fixing means for securing the plate against the frame member, the length of the slot allowing an adjustment of the position of the module before a clamping by the fixing means.

7. A module according to claim 6, wherein the internal surface of the main support of the module carries only a single drive drum for receiving the two belt side-by-side, said main support having a passage for the drive shaft of the gluing wheel for direct connection with a hub of the drum.

8. A module according to claim 6, wherein the main support has an upstream elongation to provide an extension for the twisted path of the first belt.

9. A module according to claim 6, wherein the main support plate along an upper edge is provided with gripping means.

* * * * *